United States Patent [19]

Lee

[11] 4,006,575

[45] Feb. 8, 1977

[54] CARTON SEALING MACHINE

[75] Inventor: Richard G. Lee, Boston, Mass.

[73] Assignee: Econocorp, Inc., Needham Heights, Mass.

[22] Filed: Nov. 4, 1975

[21] Appl. No.: 628,739

[52] U.S. Cl. ..... 53/38; 53/376; 53/383; 53/387

[51] Int. Cl.[2] ..... B65B 7/20

[58] Field of Search ..... 53/38, 376, 387, 383, 53/388

[56] References Cited

UNITED STATES PATENTS

| | | | |
|---|---|---|---|
| 2,912,806 | 11/1959 | Bowman | 53/387 X |
| 3,263,398 | 8/1966 | Gobalet | 53/383 X |

*Primary Examiner*—Travis S. McGehee
*Attorney, Agent, or Firm*—C. Yardley Chittick

[57] ABSTRACT

A machine for sealing the lid to the body of a paperboard carton. The lid has two end flaps and one front flap. A carton is fed into the sealer back side first. Glue is applied to the oppositely disposed end flaps. The carton is raised by an elevator to the level of another glue applying device located above the entrance to the sealer. A second carton is inserted on the lowered elevator. Both glue applying devices are then actuated simultaneously so that glue is applied to the end flaps of the second carton and the front flap of the first carton.

Thus in two stages, glue is applied to the three flaps of each carton. The cartons are progressively pushed upward by successive cartons placed on the elevator. Pressure is applied to the flaps after receiving the glue so that proper sealing occurs during the time the cartons are moving upward step by step through the pressure applying means.

9 Claims, 8 Drawing Figures

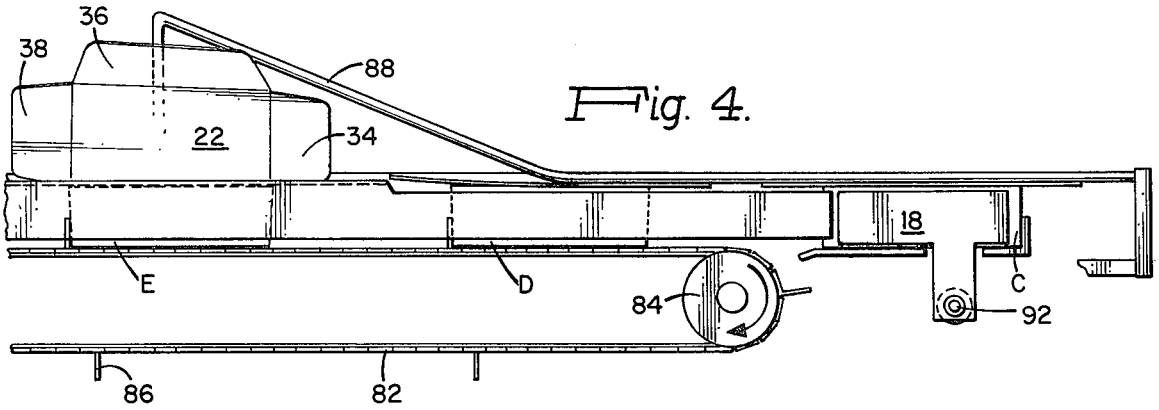
Fig. 4.
Fig. 7.
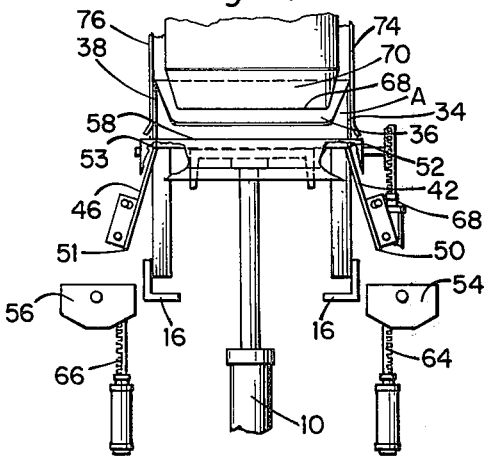
Fig. 5.
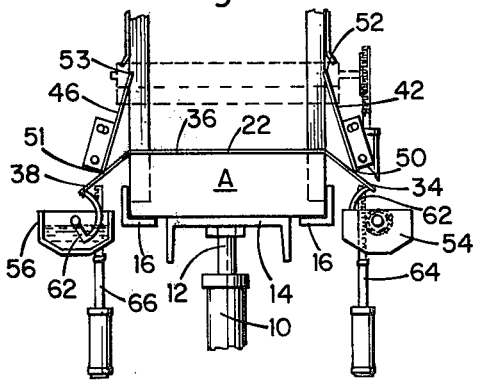
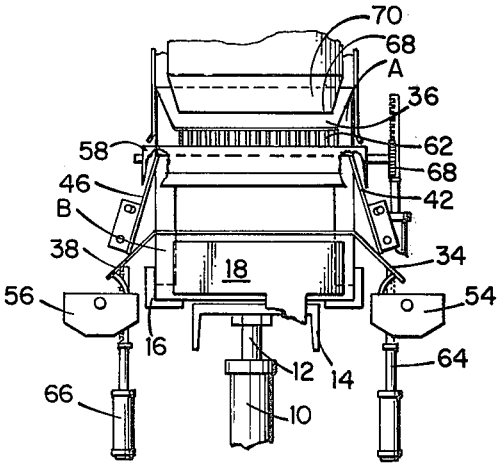
Fig. 8.
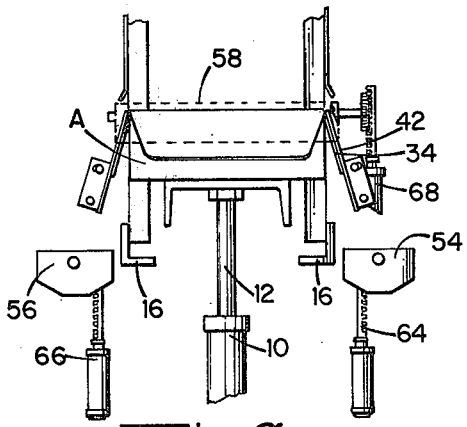
Fig. 6.

CARTON SEALING MACHINE

RELATED APPLICATION

Application of Richard G. Lee, Ser. No. 457,571 filed Apr. 3, 1974, now U.S. Pat. No. 3,921,371, for Carton Sealing Machine.

FIELD OF THE INVENTION

Machines for sealing cartons formed from precut paperboard blanks are well known in the art. A typical paperboard carton will include a lid having a front flap which is glued to the face of the front panel after the carton has been filled with merchandise. In another form the lid may have a front flap and two end flaps which are to be glued against the front panel and the two end panels of the carton. Machines are currently in use capable of simultaneously applying glue to the front and end flaps of a lid and thereafter applying pressure against the flaps so that the lid will be tightly closed and securely affixed to the carton. In such machines of the prior art however, it is essential that the carton be inserted into the machine with the front side first. This arrangement in many instances is entirely satisfactory. There are some cases, however, where the loading of the carton with merchandise makes it preferrable to feed the carton into the sealing machine back end first. In such case however, it has heretofore been impossible to apply glue simultaneously to all three of the lid flaps because of the inability to provide glue applying mechanism at the entrance through which the carton has just passed. For this reason, machines now known to the art capable of applying glue simultaneously to the three flaps of the lid require that the carton be fed into the sealer with the front side of the carton leading the way.

SUMMARY OF THE INVENTION

The present invention is particularly concerned with a carton sealing machine in which the carton is fed into the machine back end first. The carton lid has three flaps, one front and two end. With the carton in the machine, glue is applied to the end flaps but not to the front flap. An elevator then raises the first carton to a level above the entrance. At this higher level is a glue applying device extending across and above the entrance which is arranged to apply glue to the front flap. A second carton is inserted into the machine below the first carton and sitting on the elevator. All three glue applying means are then actuated simultaneously so that glue is applied to the end flaps of the second carton while at the lower level and to the front flap of the first carton at the higher level. The elevator then moves the second carton to the higher level pushing the first carton up a distance of one carton. The elevator descends and a third carton is placed on the elevator below the second carton. The glue applying means are then actuated so that glue is applied to the end flaps of the third carton and the front flap of the second carton. The elevator is again actuated and the foregoing steps are repeated as long as there are cartons to be sealed. The machine includes means for applying pressure to the end flaps and the front flap of each carton for a period long enough to insure proper adhesion of the glued parts.

The cartons may be fed into the machine by hand or automatically by a mechanical pusher. The filled cartons may be brought to the sealer by a conveyor which preferably will include means for folding the lid from vertical to horizontal position prior to insertion of the carton into the sealer.

A better understanding of the invention will be had by reference to the following specification considered in the light of the accompanying drawings in which:

FIG. 4 is a side elevation of the conveyor showing the mechanism for closing the top and the pusher for inserting the cartons into the sealer.

FIG. 5 shows a first carton inserted in the sealer positioned on the elevator and glue being applied to the end flaps.

FIG. 6 shows the first carton being elevated toward its second position and with the end flaps in the process of being pressed against the ends of the carton by the pivoted ploughs.

FIG. 7 shows the first carton elevated to second position just above the top edges of the ploughs.

FIG. 8 shows the first carton in second position, the elevator retracted and a second carton in position on the elevator. The three glue applying mechanisms are shown as simultaneously applying glue to the front flap of the first carton and to the end flaps of the second carton.

DESCRIPTION OF A PREFERRED EMBODIMENT

Figure 1:
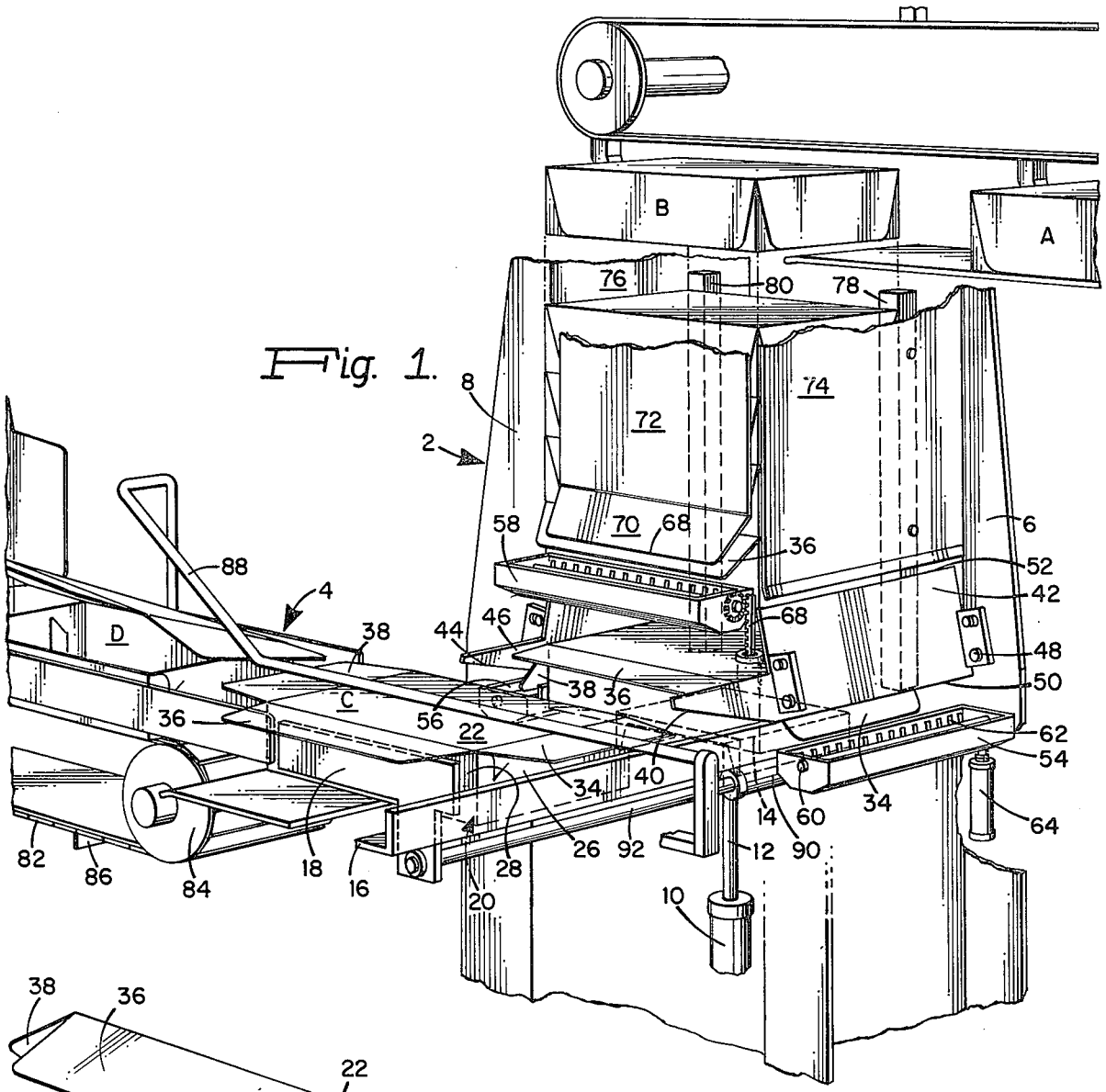
FIG. 1 is an isometric perspective view of the sealer showing also a conveyor for feeding loaded cartons to the sealer.

Referring first to FIG. 1, the sealer is shown generally at 2 and the conveyor which feeds filled cartons to the sealer is generally shown at 4.

The sealer comprises a supporting framework of which parts are shown at 6 and 8, and which rigidly supports all of the operative mechanisms.

An air operated cylinder and piston assembly are shown at 10 and 12. On the upper end of piston 12 is a platform 14, which when the piston 12 is extended acts as an elevator. The platform is large enough to properly support a carton placed thereon. A pair of parallel tracks 16 lead into the machine and straddle the sides of platform 14. A carton placed on the tracks may be pushed into the sealer manually or by a pusher such as indicated at 18. Suitable stops limit the distance the carton may be inserted along tracks 16. The carton must enter the sealer back first for reasons that will soon become apparent.

Figure 2:
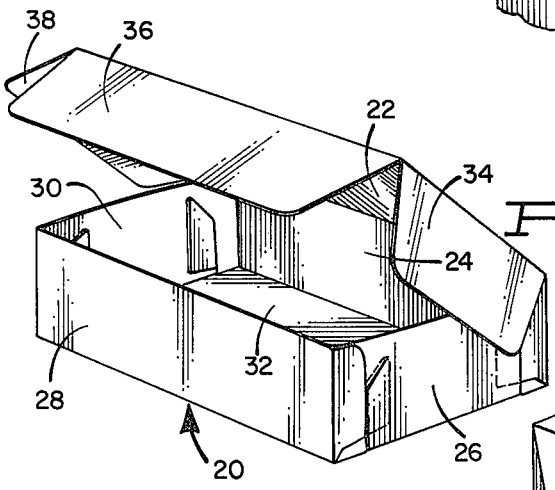
FIG. 2 is illustrative of the type of carton that can be sealed by the sealer.
Figure 3:
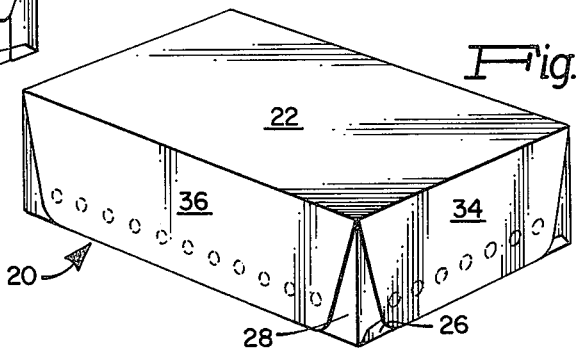
FIG. 3 is another view of the carton of FIG. 2 with the flaps in sealed condition.

A typical carton to be sealed is indicated in FIG. 2, and generally referred to at 20. The carton comprises a lid 22, a back panel 24, end panels 26, front panel 28, end panel 30, and bottom 32. The lid has three flaps extending therefrom, end flap 34, front flap 36, and end flap 38.

Ordinarily, as shown in FIG. 1, the end flaps 34 and 38 and the front flap 36 will not have been folded with respect to lid 22 prior to insertion of the carton into the sealer. As the carton is advanced into the machine, the end flap 38 will engage the downwardly sloping edge 40 of plough 42 and the end flap 34 will engage a corresponding sloping edge 44 of plough 46. Ploughs 42 and 46 are flat metal plates pivoted as at 48 with their centers of gravity inward of the pivots so that the plates normally swing inwardly. Their movement toward and away from each other is limited by suitable stops. The bottom edges 50 and 51 of the ploughs act to control the position of end flaps 34 and 38. The top edges 52 and 53 of the ploughs in normal inward position are close enough together to support each carton that may be moved thereabove.

Also associated with the sealer are three glue boxes 54, 56 and 58. Each of these boxes contains a shaft 60 on which are mounted a plurality of curved fingers 62. The ends of fingers 62 are normally immersed in liquid glue in the boxes. When the shaft 60 is rotated the fingers emerge and upon encountering a surface thereabove will deposit spots of glue thereon.

The glue box construction and the mechanisms for causing rotation of the shaft and the glue fingers are shown in detail in my co-pending application Ser. No. 457,571 filed Apr. 3, 1974, now Pat. No. 3,921,371, for Carton Sealing Machine.

Referring now to FIG. 5, a first carton A has been inserted in the sealer. It is resting on the elevator comprised of cylinder 10, piston 12 and platform 14. The end flap 34 has been bent down by plough 42 and held in downward sloping position by the plough's lower edge 50. Similarly end flap 38 has been bent down by the other plough 46 and is held in position by its lower edge 51. Front flap 36 of carton A still extends horizontally from the lid 22, which is likewise in horizontal closed position. At this time the pistons 64 and 66 are actuated to cause rotation of the glue fingers 62 in glue boxes 54 and 56 so that spots of glue are deposited on the undersides of end flaps 34 and 38. The fingers 62 are then retracted. Immediately thereafter the elevator 14 begins to move upward and the end flaps 34 and 38 are progressively turned toward the vertical by their sliding engagement with the interior sides of ploughs 42 and 46.

FIG. 6 is illustrative of the position of the various parts as the elevator is approximately halfway through its upward stroke. In FIG. 6 is shown the front crosswise extending glue box 58, which for clarity was omitted in FIG. 5. The shaft 60 and glue fingers 62 in glue box 58 are actuated by the cylinder and piston assembly 68.

Upon the completion of the upward stroke of the elevator 14, the bottom of carton A will have passed the upper edges 52 and 53 of ploughs 42 and 46 which edges then swing inwardly to be under opposite edges of the carton. The elevator 14 then descends to its original position between the tracks 16 as shown in FIGS. 5 and 8.

As the carton A was ascending from its position in FIG. 5 to the position in FIG. 7, the front flap 36 was first bent down along the score line between it and lid 22 as it passed behind glue box 58. On reaching the higher position in FIG. 7, the front flap 36 is held in downwardly sloping position by the lower edge 68 of an outwardly extending guide member 70. The front flap 36 when held in this position will be accurately located to receive glue from the glue fingers 62 in glue box 58. The guide 70 as can been seen in FIG. 1 is the lower portion of a front wall 72. Wall 72 along with vertical guides 78 and 80 and side wall 74 and 76 constitute means for applying pressure against the flaps as the cartons move upward therebetween and as will be explained in more detail hereinafter.

It will also be noted in FIG. 7 that carton A has reached a position where the end flaps 34 and 38 are being firmly pressed against the end panels of the carton by the walls 74 and 76 which are precisely spaced to accomplish this result.

Referring now to FIG. 8, a second carton B has been inserted in the sealer along tracks 16, either by hand or by the pusher 18. Carton B is identical to carton A and like parts therein will be given the same number as those parts in carton A. Accordingly in FIG. 8 the end flaps 34 and 38 of carton B are held by the ploughs 42 and 46 in proper position over the glue boxes 54 and 56, and likewise the guide 70 is holding front flap 36 of carton A in proper position over glue box 58. With these conditions prevailing, the pistons 64, 66 and 68 are all simultaneously actuated so that glue is applied to the end flaps 34 and 38 of carton B and glue is applied to the front flap 36 of carton A. As soon as this has occurred the elevator 14 functions to raise carton B to pass between ploughs 42 and 46 which close and press end flaps 34 and 38 against end panels 26 and 30 of the carton. In due course the lid of carton B will engage the bottom of carton A and, as the elevator continues its upward movement, carton B will reach the position formerly occupied by carton A and carton A will be pushed upwardly between the walls 72, 74 and 76 a distance equal the height of one carton. As carton A moves upward, the guide 70 acts to fold front flap 36 down to vertical position to engage front panel 28. Suitable pressure is applied by vertical guides 78 and 80 which are affixed to the walls 74 and 76 at an exact distance from wall 72. This distance is such that the front flap 36 will be continuously and firmly pressed against the front panel 28.

From the foregoing description it will now be appreciated that the three flaps 34, 36 and 38 of the lid of carton A have had glue applied thereto in two stages. Glue was first applied to flaps 34 and 38. Then as carton A was moved upwardly to a second higher position pressure was applied against the end flaps 34 and 38. At this second position glue was applied to flap 36. Then as carton A was moved up another step by the arrival of carton B pressure was applied against the front flap 36. At this point carton A is completely closed and the glue is drying.

As soon as carton B has been moved upward by elevator 14 to displace carton A it will be appreciated that the end flaps 34 and 38 of carton B will now also come under pressure from walls 74 and 76 and that the front flap 36 of carton B will now be held in proper sloping position over glue box 58. The elevator then descends leaving carton B supported by ploughs 42 and 46. Another carton is now positioned on the elevator. The preceding series of operations are then repeated for such time as there are other cartons to be sealed.

In due course the pile of cartons contained within the walls 72, 74, 76 and the back guides 78 and 80 will reach the top of the structure. By this time the glue will have throughly set and the top carton may then be manually removed or mechanically pushed off onto a conveyor or other receiving surface as suggested by the structure shown at the top of FIG. 1.

It has already been pointed out that the cartons may be placed in the sealer either by hand or preferably by mechanical means such as shown in FIG. 1. A brief description of the conveyor and inserting means will now be given.

Referring to FIGS. 1 and 4, there is a link or belt conveyor 82 running over suitable power driven rollers, one of which is shown at 84. The conveyor may include dogs 86 to insure that the cartons indicated at C, D and E will be delivered in proper timed sequence to the sealer for maximum output.

As the loaded carton shown at E in FIG. 4 moves toward the sealer, the lid 22 and flaps 34, 36 and 38 all extend vertically upward from the back panel 24. A sloping lid folding rod 88 mounted on the machine as indicated in FIG. 1 engages the lid in such manner that the lid will be folded from vertical to horizontal position. When it reaches the location of carton C in front of the sealer, the lid and the flaps will be in horizontal position and maintained in this condition until the carton is pushed back first into the sealer by the pusher 18. Pusher 18 is automatically operated by an air cylinder 90 and related piston 92. Once the pusher has placed the next carton in the sealer, the sequence of operations of applying glue to the end flaps, moving the carton upward above the top edges of the ploughs, inserting the next carton on the elevator and then applying glue simultaneously to the end flaps of the bottom carton and to the front flap of the upper carton occurs so rapidly that the glue cannot set before the end flaps and front flap have been pressed against their respective front and end panels.

The above disclosure will suggest to others skilled in the art modifications which are within the scope of the invention as defined by the appended claims.

I claim:

1. A carton sealing machine for applying glue to the two end flaps and the front flap of a carton lid and then applying pressure against said flaps to cause them to adhere to the related panels of the carton, said machine comprising means for holding said lid in closed position at a first location with said two end flaps extended, first and second means for applying glue to the said two end flaps only at said first location, means for moving said carton upward to a second location, means for applying pressure against said two end flaps to cause said two end flaps to adhere to their respective panels, means for holding said front flap in extended position while said carton is at said second location, third means for applying glue to said front flap while said carton is at said second location, means for moving said carton to a higher third location while continuing the pressure against said two end flaps and means for applying pressure against said front flap to cause said front flap to adhere to its respective panel.

2. The machine set forth in claim 1, said means for moving said carton from said first location to said second location comprising a retractable elevator, and means for holding said carton in said second location when said elevator is retracted.

3. The machine set forth in claim 2, the means for moving said carton from said second location to said third location comprising said elevator and another carton interposed at said first location between said elevator and the underside of said first carton then at said second location.

4. The machine set forth in claim 3, said first and second means for applying glue to the two end flaps of a carton at said first location arranged to act simultaneously with the third means for applying glue to the front flap of a carton at said second location.

5. The machine set forth in claim 1, the means for applying pressure to said two end flaps comprising parallel walls spaced so that the carton fits endwise snugly therebetween, and the means for applying pressure to said front flap comprising a front wall at right angles to said parallel walls and other members parallel to said front wall located at the rear of said carton and fixed to said parallel walls, said front wall and said members spaced so that said carton from front to back fits snugly therebetween.

6. A carton sealing machine for sealing the end flaps and front flap of the carton lid to the related panels of the carton, said machine compising first and second spaced glue applying means at a first level and a third glue applying means at a higher second level and located laterally of said first and second glue applying means, means for supporting a first carton at said second level with the lid closed and the front flap extended, means for temporarily supporting a second carton at said first level with the lid closed and all flaps extended, means for substantially simultaneously actuating all said glue applying means whereby glue will be applied to said front flap of said first carton at the said second level and to the end flaps of said second carton at the said first level, means arranged to raise said second carton to said second level and said first carton to a higher third level, means for pressing said front flap of said first carton against its related panel at the third level and at positions thereabove and means for pressing said end flaps of said second carton against their related panels at the second level and at positions thereabove.

7. A machine for gluing the two end flaps and the front flap of a closed lid to the end panels and front panel of a carton, said machine comprising first and second spaced glue applying means for applying glue to the extending end flaps of the lid of a first carton at a first level, a third glue applying means for applying glue to the extending front flap of said lid of said first carton at a second higher level, means for supporting said first carton between said first and second glue applying means while the glue is being applied to said end flaps of said lid at said first level, means for moving said first carton upward to the higher level of said third glue applying means, means for returning said carton supporting means to said first level to receive a second carton thereon, means supporting said first carton at said second level after descent of said carton supporting means to said first level, means for causing substantially simultaneous operation of said first, second and third glue applying means whereby glue will be applied to the said end flaps of the lid of said second carton at the first level and to the front flap of the lid of said first carton at the second level and means for thereafter exerting pressure against said end flaps and said front flap to cause adherence of said flaps to their respective panels.

8. The method of treating a succession of cartons whereby the lid of each carton is secured to the carton body in which each said lid has oppositely disposed and extended end flaps and an extended front flap which flaps are to be glued to their respective panels when the lid is closed, said method comprising the steps of closing the lid of a first carton, applying glue to the extended end flaps of the lid while the carton is at a first location, pressing the said end flaps against their respective panels while moving the carton upward to another location, placing a second carton in said first location with its lid closed and said end and front flaps extended, simultaneously applying glue to the front flap of said first carton and to the end flaps of said second carton, then moving said first and second cartons simultaneously upward to a third location and said second location respectively while at the same time pressing the front flap of the said first carton against its related panel and pressing the end flaps of said second carton against their related panels, placing a third carton in said first location with its lid closed and said end and front flaps extended and then repeating the aforesaid steps with respect to the cartons then located in said first and second locations.

9. A carton sealing machine comprising two spaced glue applying means at one level and a third glue applying means at a higher second level, said first two glue applying means so located as to be able to apply glue to the oppositely disposed end flaps of a closed carton lid when the carton is placed there between at said one level, said third glue applying means positioned at the front of said machine and high enough above said two glue applying means to permit a carton to pass horizontally thereunder as said carton is being placed between said two glue applying means, means for raising said carton from said one level to said higher second level, said third glue applying means so located at said higher second level so as to be able to apply glue to the front flap of said closed carton lid after said carton has been raised to said higher second level following the application of glue to said end flaps at said one level and means for pressing said end flaps and front flap against their respective carton panels after glue has been applied thereto.

* * * * *